US006753824B2

(12) United States Patent
Thudor et al.

(10) Patent No.: US 6,753,824 B2
(45) Date of Patent: Jun. 22, 2004

(54) COMPACT, PLANAR ANTENNA WITH TWO PORTS AND TERMINAL COMPRISING SAME

(75) Inventors: Franck Thudor, Rennes (FR); Philippe Minard, Rennes (FR); Ali Louzir, Rennes (FR); Françoise le Bolzer, Rennes (FR)

(73) Assignee: Thomson Licensing, S.A., Boulogne-Billancourt (FR)

( * ) Notice: Subject to any disclaimer, the term of this patent is extended or adjusted under 35 U.S.C. 154(b) by 24 days.

(21) Appl. No.: 10/224,716

(22) Filed: Aug. 21, 2002

(65) Prior Publication Data

US 2003/0048231 A1 Mar. 13, 2003

(30) Foreign Application Priority Data

Aug. 29, 2001 (FR) ..... 01 11193

(51) Int. Cl.[7] ..... H01Q 13/12

(52) U.S. Cl. ..... 343/769; 343/700 MS; 343/767

(58) Field of Search ..... 343/767, 769, 343/770, 700 MS, 846

(56) References Cited

U.S. PATENT DOCUMENTS

| | | | | | |
|---|---|---|---|---|---|
| 4,893,126 | A | * | 1/1990 | Evans | 342/175 |
| 5,621,419 | A | * | 4/1997 | Meek et al. | 343/770 |
| 5,714,961 | A | | 2/1998 | Kot et al. | 343/769 |
| 5,892,487 | A | * | 4/1999 | Fujimoto et al. | 343/840 |
| 5,905,471 | A | * | 5/1999 | Biebl et al. | 343/769 |
| 6,160,522 | A | * | 12/2000 | Sanford | 343/769 |
| 6,219,002 | B1 | * | 4/2001 | Lim | 343/769 |

FOREIGN PATENT DOCUMENTS

| | | |
|---|---|---|
| EP | 0685901 A2 | 12/1995 |
| WO | WO98/15030 | 4/1998 |

* cited by examiner

*Primary Examiner*—Shih-Chao Chen
(74) *Attorney, Agent, or Firm*—Joseph S. Tripoli; Kuniyuki Akiyama

(57) ABSTRACT

Compact, planar antenna made on a substrate comprising an annular slot which is dimensioned to operate at a given frequency and which is placed in a short-circuit plane of a line via which the antenna slot is fed. A second slot feed line is symmetrically disposed with respect to the first line in the line short-circuit plane common to them. Each of the lines, furnished with a port, is connected to a switching facility so as to allow the feeding of the antenna through one or the other of the two ports.

12 Claims, 4 Drawing Sheets

COMPACT, PLANAR ANTENNA WITH TWO PORTS AND TERMINAL COMPRISING SAME

This application claims the benefit under 35 U.S.C. §365 of French patent application No. 0111193 filed Aug. 29, 2001.

BACKGROUND OF THE INVENTION

The invention pertains to the field of telecommunications and relates to a compact, planar antenna which is made on a substrate in the form of an annular slot, designed to operate at a given frequency, which is placed in a short-circuit plane of a line via which this slot is fed.

It also relates to telecommunications terminals and in particular to the terminals of wireless mobile and domestic networks, where a compact and planar antenna such as this is desired in order to allow a terminal to utilize one and the same polarization on transmission and on reception.

For practical purposes and in order to occupy just a small volume, numerous wireless telecommunications terminals make use of one and the same antenna, made in a compact form, to transmit and receive. In a known form of embodiment, each terminal includes an antenna switch making it possible to link its antenna alternately either to a transmission module, or to a reception module of which it makes use. As is known, the power delivered by a terminal to its antenna within the context of a transmission is markedly greater than that which it receives within the context of a reception. The antenna switch, designed to operate with these different powers, often has the drawback of introducing appreciable losses which degrade the performance of the terminal, both on transmission and in reception, and moreover it has a cost which is relatively high.

A solution utilized within the context of point-to-point links' makes it possible to avoid the use of an antenna switch, it consists in feeding the antenna of a terminal on two orthogonal polarizations. In one form of embodiment, a first linear and horizontal polarization is used for transmission from a terminal, a second linear and vertical polarization being used in reception. However, this solution necessitates that communicating terminals have dissymmetric antennas, the polarization of a terminal on transmission corresponding to the polarization in reception of the terminal with which it is communicating and vice-versa.

Within the context of wireless telecommunications networks, it is generally desired to retain the same polarization for the transmit and receive pathways of the terminals. This has led to solutions envisaging the use of two antennas per terminal, one for transmission and the other for reception, so as to be able to retain the same polarization.

BRIEF SUMMARY OF THE INVENTION

The invention proposes a compact, planar antenna made on a substrate comprising an annular slot which is dimensioned to operate at a given frequency and which is placed in a short-circuit plane of a linevia which the said antenna slot is fed.

According to a characteristic of the invention, the antenna comprises a second slot feed line which is symmetrically disposed with respect to the other in the said short-circuit plane common to them, each of the feed lines, furnished with a port making it possible to supply the antenna, being connected to a switching facility by way of which this port can be rendered active or passive, so as to allow in particular alternate use of one and the same polarization on the basis of two distinct ports, one for the purposes of transmission and the other for the purposes of reception. The invention also pertains to a telecommunications terminal of the type including an antenna, as well as a rig for transmission and a rig for reception by radio both utilizing the antenna.

BRIEF DESCRIPTION OF THE DRAWINGS

The invention, its characteristics and its advantages are specified in the description which follows in conjunction with the figures mentioned hereinbelow.

DESCRIPTION OF PREFERRED EMBODIMENTS

The compact antenna, described hereinbelow, is more especially intended to equip a telecommunications terminal including a rig for transmission and a rig for reception by radio which alternately utilize the antenna to transmit and receive.

Figure 1:
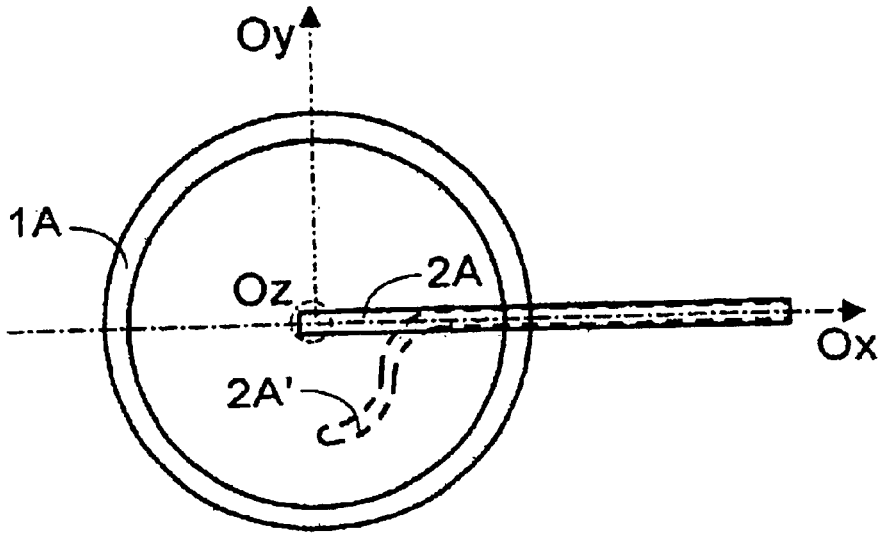
FIG. 1 PRIOR ART
FIG. 1 depicts a basic layout relating to two known variants of a compact antenna with annular slot of circular form, one with an axial and rectilinear feed line, which is drawn solid and the other with an axial feed line comprising a doubly curved part which is drawn dashed.

The basic layout depicted in FIG. 1 shows an exemplary known compact antenna of planar type with annular slot 1A. This antenna is assumed to be made on a substrate metallized on both its faces, it is capable of being utilized in transmission and in reception, when it is associated with a conventional antenna switch.

The annular slot 1A, shown in circular form, is made for example by etching, on one of the substrate's metallized faces which is intended to constitute the earth plane of the antenna.

A feed line 2A is provided for feeding the annular slot 1A with energy, via an antenna switch, not represented. It is for example made in microstrip technology or in coplanar technology.

In the example proposed, it is assumed that the feed line 2A takes the form of a microstrip line which is positioned on the other side of the substrate with respect to the slot and which is disposed radially with respect to the centre of the annulus formed by the slot, as illustrated dashed. The line/annular slot transition is made in a known manner so that the slot lies in a short-circuit plane of the line where the currents are biggest. The perimeter of the slot 1A is chosen equal to a multiple "m" of the wavelength to be guided, "m" being a positive integer number.

The resonant frequencies of the various possible modes are practically integer multiples of the frequency f0 and correspond in particular to the fundamental mode, to the first higher mode, etc. The length of the line part situated inside the slot annulus is dependent on the wavelength of the signal which is to be injected into the line.

As is known, a deformation of the feed line has hardly any effect as regards matching and radiation. It is therefore possible to utilize this possibility, if need be.

A feed line 2A' modified in this way is drawn dashed in FIG. 1, it comprises a rectilinear part, here situated essentially outside the interior space delimited by the slot, and a doubly curved terminal part extending a rectilinear part portion located in the interior space mentioned hereinabove. It is assumed to be dimensioned so as to operate on the same wavelength as the feed line 2A. Here the curvatures are utilized in order to distance the ends of the feed lines from the centre of the annulus, in such a way as to facilitate the hooking up of components to these ends.

The studies carried out by simulation show that an antenna with circular slot fed by a line, such as 2A, and a corresponding antenna fed by a line, such as 2A', exhibit practically the same radiation diagrams in the E and H planes. These planes correspond to the xOz and yOz planes of a reference trihedron whose xOy plane coincides with that defined by the substrate of the antenna comprising the slot 1A, the point O then being located at the centre of the annulus formed by the slot.

Figure 4:
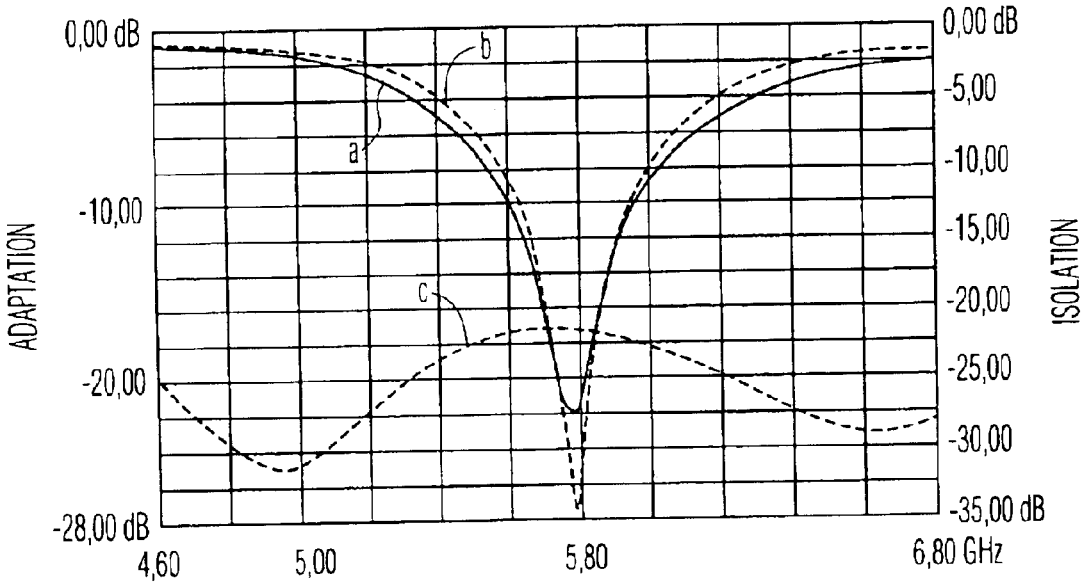
FIG. 4 depicts a set of curves obtained by simulation which illustrate the variations in the matching and in the isolation for an antenna with two ports, according to FIG. 2 and the variations in the matching for an antenna with single port per feed line comprising a doubly curved part, such as drawn dotted in FIG. 1.
Figure 6:
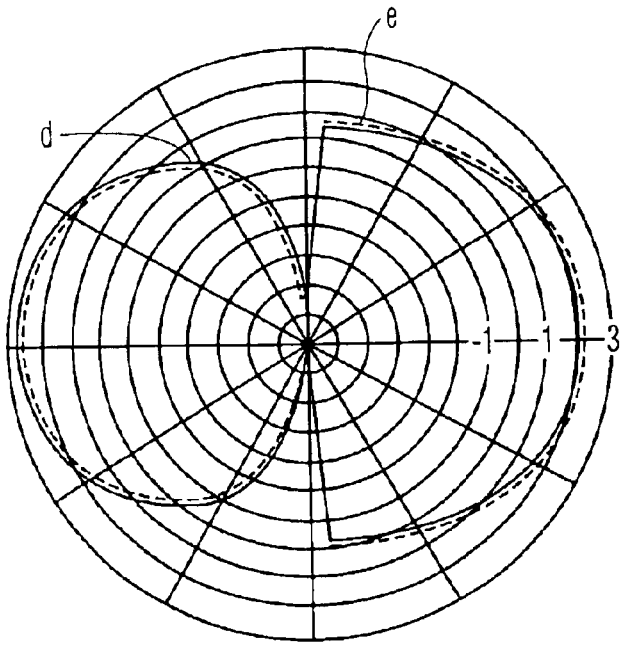
FIGS. 6 and 7 depict the radiation diagrams respectively obtained by simulation in the E and H planes, corresponding to the xOz and yOz planes of the reference trihedron, for a slot with two ports, according to the invention and for a known slot, with offset port.
Figure 7:
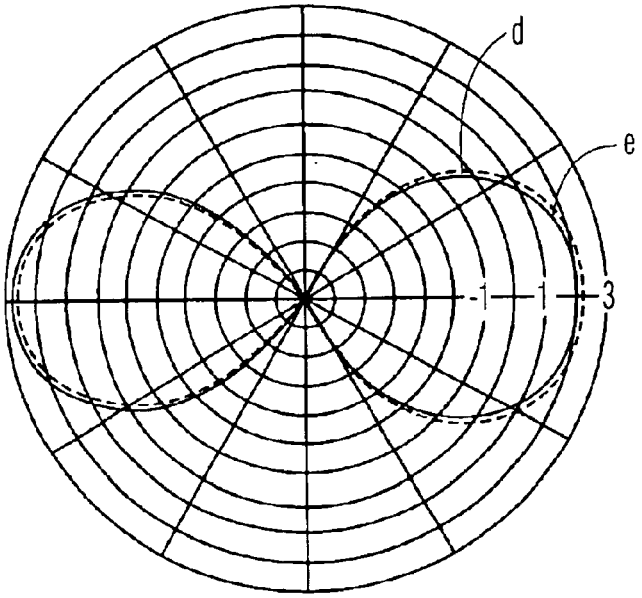

The same holds as regards the diagrams representing the matching as a function of frequency for the two antennas thus obtained. The various diagrams mentioned hereinabove are not all illustrated here insofar as, on the one hand, the differences which they exhibit are practically invisible on the scale of the figures proposed and as, on the other hand, the curves which constitute them correspond to all intents and purposes to those which are depicted in FIGS. 4, 6 and 7.

According to the invention, it is chosen to associate two feed lines with at least one annular slot of a planar, compact antenna so as t&l obtain two distinct ports having the same polarization. Accordingly, two microstrip lines are, for example, provided. They are laterally offset in a corresponding manner on either side of a theoretical axis x'x passing through the point O situated at the centre of the slot annulus, this point O serving as origin for a reference trihedron whose xOy plane coincides with the plane of the antenna substrate. Specifically, a study by simulation shows that a slight offset has practically no effect, the diagrams obtained and in particular those for radiation and matching versus frequency correspond to those mentioned hereinabove.

According to the invention, there is also provision to be able to act by switching at the level of the respective ports of each of the two feed lines in such a way that each port can be rendered active or passive alternately, according to need. This switching can be obtained by various means, it can in particular enable the antenna to be fed vial one of the lines whose port is rendered active by way of a switching facility, while the feeding of the antenna via the other line is turned off by the action of a second switching facility.

Figure 2:
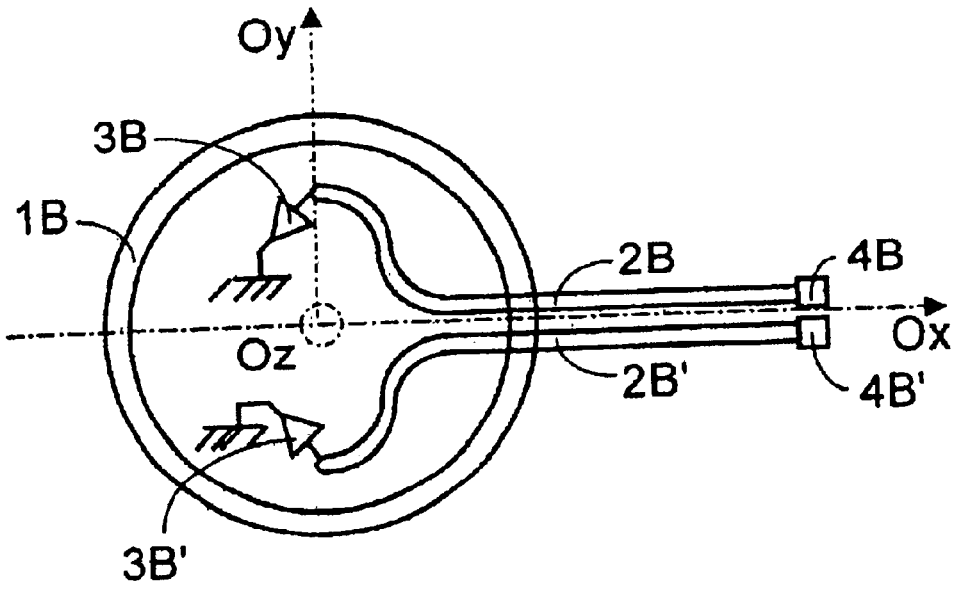
FIG. 2 depicts a first exemplary compact antenna of planar type with annular slot, according to the invention, which makes it possible to utilize one and the same polarization for two distinct ports.
Figure 3:
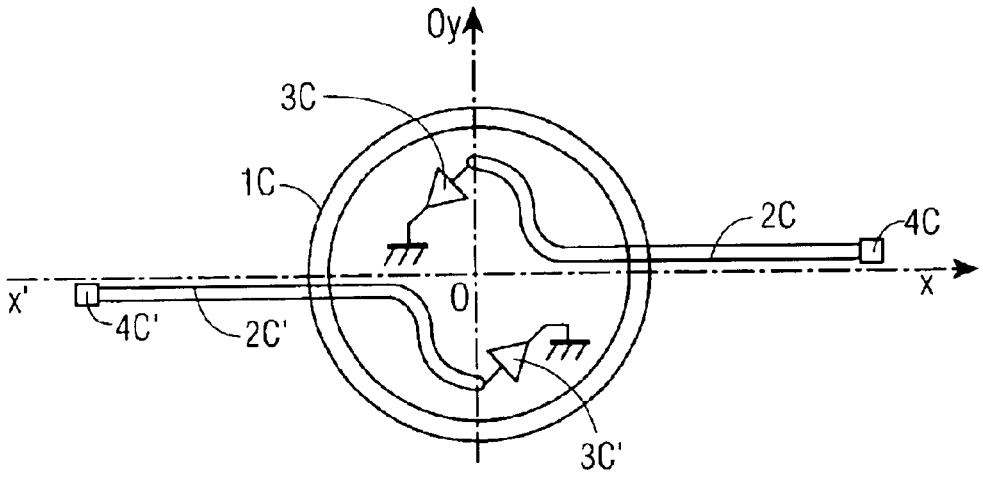
FIG. 3 depicts a second exemplary compact antenna of planar type with annular slot offering one and the same polarization for two distinct ports, according to the invention.

A first example of a compact antenna according to the invention is depicted in FIG. 2. This antenna comprises an annular slot 1B fashioned at the level of a face of a substrate, in a manner which corresponds to that envisaged for the slot 1A. Two feed lines 2B and 2B' are provided, they are assumed here to correspond in their forms to the feed line 2A'. It is alternatively possible to make them along the example of the feed line 2A, as envisaged hereinabove, or to give them some other appropriate form and, for example, a form comprising a single curve per line, rather than a double curve such as illustrated in FIGS. 1 to 3.

In the exemplary embodiment proposed in FIG. 2, the two feed lines 2B and 2B' are assumed to be symmetrically offset on either side of a half-axis Ox of the reference trihedron centred on the centre O of the slot annulus 1B. The lines 2B and 2B' which are illustrated comprise rectilinear parts running parallel to the half-axis Ox. Two ports 4B and 4B' conventionally each make it possible to feed one of the lines 2B, 2B' via an end. This end is here assumed to be situated outside the interior space delimited by the slot 1B.

Two switching facilities make it possible to act on the impedances respectively exhibited by the feed lines. Here these facilities are represented in the form of diodes 3B and 3B' which make it possible for an end of each of the feed lines to be earthed separately, when they are switched to the on state.

The feed lines 2B and 2B' are for example designed to be utilized alternately the one for transmission and the other for reception and the diodes 3B and 3B' are therefore selectively voltage-controlled in a manner known per se so that one is on and the other off. One and the same antenna polarization can be obtained in both cases. Other forms of utilization can also be envisaged and in particular two feed lines such as 2B and 2B' can enable two different circuits to transmit alternately by means of the same antenna with slot 1B in the same frequency band; for example by utilizing different standards, such as Hiperlan2 for one and IEEE 802.11a for the other.

The switching facilities and hence in particular the diodes envisaged here are placed on the same side of the substrate as the microbands of the feed lines, this being facilitated by the curvature given to these lines. In the example proposed, the diodes are each linked to an end of a supply line, away from the port via which the line is fed, this end being that which is in the space internally delimited by the slot annulus. Each of them is turned on or off according to the bias voltage which is applied at the level of the port of the line at the end of which it is linked.

When a diode situated at the end of a feed line is off, the impedance exhibited at the line end is equivalent to an open circuit and it is manifested as a short-circuit at the level of the line/slot transition, when the choice of line length corresponds to a quarter of the wavelength $\lambda m$, this allowing coupling between the line and the slot. On the other hand, when a diode at the end of one of the lines is on, the impedance at the extremity of this line is equivalent to a short-circuit and it is manifested as an open circuit at the level of the line/slot transition, thereby preventing coupling between the line and the slot.

The annular slot 1B can have a non-circular form making it impossible to increase its perimeter and resulting for example from one or more indentation deformations which are oriented towards its centre O in the plane of the substrate in which it is made. These deformations are situated in the short-circuit plane zones for the slot, where the electric field is a minimum.

Moreover, an annular slot such as depicted in FIG. 2 can be associated with at least one other slot in an antenna so as to allow this antenna to operate at several frequencies. One of the slots is then located at the level of the interior space which lies at the centre of the other. Each slot is dimensioned to operate at a frequency. The excitation of the slots can be obtained via feed lines such as envisaged hereinabove, each slot being crossed by the two feed lines with which the antenna is furnished. This enables in particular a multiband and/or broadband antenna to be made. A variant embodiment of a compact antenna is proposed in FIG. 3, the annular slot 1C envisaged corresponds to the slots 1A and 1B. Like them, it can be associated with another concentric annular slot operating at the same frequency and in a different mode. Two feed lines 2C and 2C' are also envisaged, here they are assumed to have a form which corresponds to that of the feed line 2A', while being disposed symmetrically with respect to the centre O of the slot annulus 1C. These feed lines 2C and 2C' may possibly be aligned along the x'x axis passing through the centre O which serves as origin for a reference trihedron whose xOy plane coincides with the plane defined by the antenna substrate. Here they are assumed to be disposed parallel with respect to this axis x'x. Two ports 4C and 4C', situated on either side of the slot annulus, each make it possible to feed one of the feed lines. Two diodes 3C and 3C' make it possible to act on the impedances respectively exhibited by the feed lines 2C and 2C' at the level of the line/slot transition.

The coupling of the slot 1C, alternately to one or the other of the feed lines 2C and 2C', can be obtained under the same conditions as for the coupling of the slot 1B to the lines 2B and 2B'.

Thus, for example, the application of a zero voltage at the level of a port, such as 4C or 4C', is used to turn off the diode to which it is linked, such as 3C or 3C' respectively, and therefore enables this port to be active. The application of an appropriate positive voltage Vcc at the level of the other port causes the diode to which this other port is linked to conduct and renders this port inactive.

Moreover, the annular slot 1C can be deformed and/or associated with another slot, for the same reasons and under the same conditions as the slot 1B.

FIG. 4 makes it possible to illustrate the simulation results obtained for a planar, compact antenna with annular slot and with two ports offering one and the same polarization, according to the invention, as depicted in FIG. 2.

This simulation assumes that one of the diodes 3B and 3B' corresponds to a perfect short-circuit and the other to a perfect open circuit. It yields the variations in the matching and in the isolation which are obtained as a function of frequency, the measurement units being decibels and gigahertz respectively. By way of reference, the curve "a" of FIG. 4 illustrates the variation in the matching in the case of an antenna with annular slot furnished with a doubly curved feed line which is offset, as depicted under the reference 2A' in FIG. 1. A matching value of −22 dB is obtained there for the central frequency which is 5.80 GHz. This curve "a" allows comparison with the result illustrated by the curve "b" which is obtained in the case of an antenna with annular slot furnished with two ports, as depicted in FIG. 2, the two antennas under comparison having equivalent annular slots. The simulation shows that the matching obtained with the antenna with two ports of FIG. 2 corresponds practically to that obtained with the antenna with single offset port of FIG. 1. The curve "c" of variation of isolation between ports, as a function of frequency, shows that the isolation, which can be obtained, always remains greater than 20 decibels in the case of the antenna with two ports.

Figure 5:
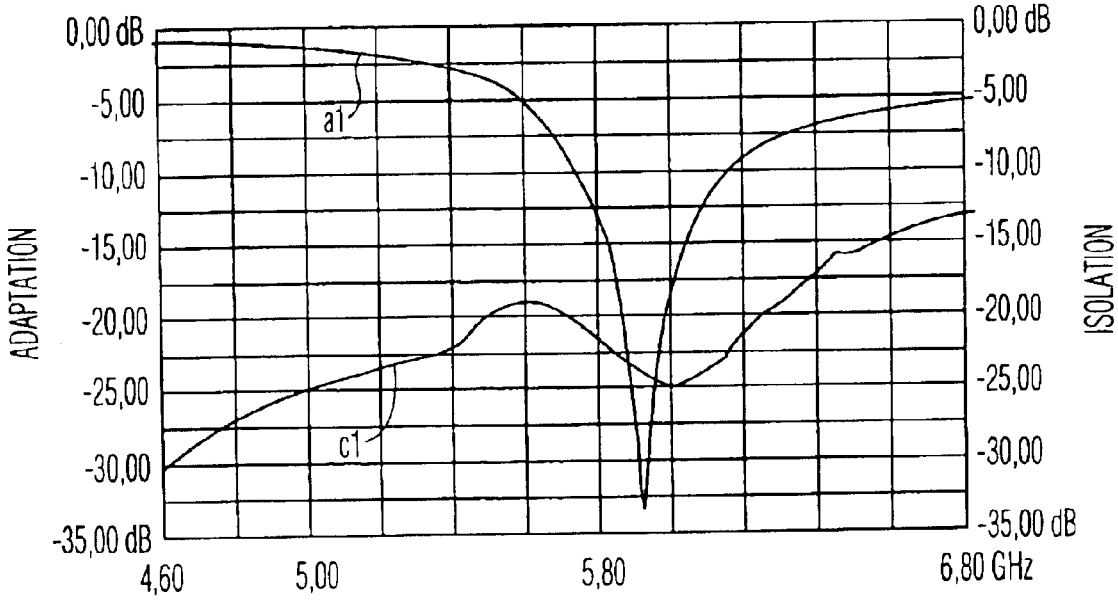
FIG. 5 depicts a set of curves illustrating the expected variations in respect of the antenna with two ports according to FIG. 2, on the basis of a simulation allowing for the parameters of real diodes.

FIG. 5 makes it possible to illustrate the simulation results obtained for the antenna, as depicted in FIG. 2, when the parameters of real diodes are taken into account.

Curve "a1" illustrates the variation in the matching as a function of frequency and it shows that the curve, with a V shape, which is obtained corresponds to curve "a" depicted in FIG. 4, apart from a slight offset towards the high frequencies for the central frequency, it being possible for this offset to be eliminated, as is known. The curve "c1" of variation of the isolation between ports, as a function of frequency, shows that the isolation retains a value of around 20 decibels in particular in the vicinity of the central frequency.

FIGS. 6 and 7 depict the radiation diagrams obtained respectively in the E and H sectional planes, for a slot with offset port, such as the slot 2A' of FIG. 1, and a slot with two ports, such as is depicted in FIG. 2. It is undeniably apparent that the dashed graph which is referenced "d" in FIG. 6 is not modified in its general form relative to the solid graph referenced "e" which is established for the slot with offset port according to FIG. 1.

Figure 8:
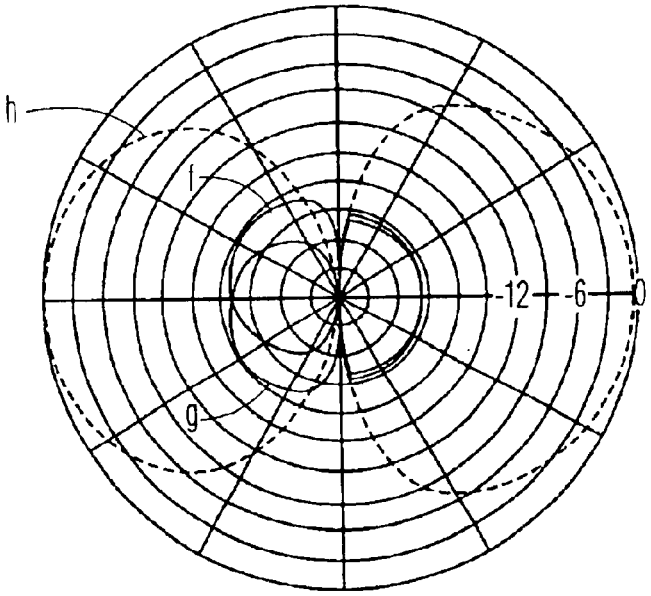
FIG. 8 depicts a set of curves illustrating the cross-polarization and the co-polarization which are obtained in the H plane for an antenna with two ports according to the invention, as is depicted in FIG. 2, in the two cases where one port is active while the other is off.

FIG. 8 depicts a radiation diagram in the H plane wherein are illustrated the graphs representative of cross-polarization and of co-polarization for the antenna illustrated in FIG. 2. The graph referenced "F" corresponds to the cross-polarization obtained when the diode 3B is off, while the diode 3B' is on. The left lobe of the graph is then offset upwards in the diagram relative to the right lobe which remains practically centred on the x'x axis, despite a slight upward offset. The graph referenced "g" corresponds to the cross-polarization obtained when the diode 3B' is off, while the diode 3B is on. The right and left lobes of the graph "g", which are obtained, are disposed symmetrically with respect to those of the graph "f" in a symmetry along the x'x axis and they are therefore offset downwards in the diagram in a manner which corresponds to the upwards offset which relates to the lobes of the graph "f".

The co-polarizations which are obtained under one or the other of the two diode conditions stated hereinabove, are manifested as graphs which practically coincide at the level of the diagram depicted and on the scale considered with a graduation in intervals of 6 decibels. These two graphs are therefore illustrated here by a single dashed plot which is referenced "h".

This shows that under good conditions it is therefore possible to obtain one and the same polarization for two ports per feed line, at the level of a compact antenna with annular slot fashioned at the level of a planar substrate. As indicated earlier, the annular slot can be a circular or deformed annulus, and it can be associated with at least one other annular slot positioned like it in the same substrate zone. The two feed lines, assumed here to be made on a substrate face where they unfurl as a rectilinear part and a curved or rectilinear oblique part; this part being illustrated here in the form of a double curve. They may possibly be made in different forms and/or in different respective positions, depending on need.

The switching facilities which here are assumed to consist of diodes may of course be embodied in various functionally corresponding electronic or electromechanical forms. In the case of diodes, it is of course possible to modify the directions of bias, if this is useful for the application envisaged.

What is claimed is:

1. A compact, planar antenna made on a substrate comprising an annular slot which is dimensioned to operate at a given frequency and which is placed in a short-circuit plane of a line, referred to as the first line, via which this antenna slot is fed, said antenna comprising a second slot feed line which is symmetrically disposed with respect to the first line in the line short-circuit plane common to them, each of the feed lines, furnished with a port making it possible to supply the antenna, being connected to a switching facility by way of which this port can be rendered active or passive wherein the switching facility is an electronic or electromechanical facility.

2. The antenna, according to claim 1, characterized in that it comprises two feed lines symmetrically offset on either side of an axis passing through the centre of the annular slot which these lines make it possible to feed.

3. The antenna, according to claim 2, characterized in that each of the feed lines, with which it is furnished, comprises a rectilinear part crossing the annular slot at the level of which it creates an excitation point, the respective rectilinear parts of these lines being disposed parallel to one another.

4. The antenna, according to claim 1, characterized in that it comprises two feed lines which are symmetrically disposed with respect to the centre of the annular slot which they make it possible to feed.

5. The antenna, according to claim 4, characterized in that each of the feed lines, with which it is furnished, comprises a rectilinear part crossing the annular slot at the level of which it creates an excitation point, these rectilinear parts being aligned along an axis which passes through the centre of the annular slot.

6. The antenna, according to claim 4, characterized in that each of the feed lines, with which it is furnished, comprises a rectilinear part crossing the annular slot at the level of which it creates an excitation point, these rectilinear parts being parallel to an axis which passes through the centre of the annular slot and with respect to which they are laterally offset.

7. The antenna, according to claim 3, characterized in that each of the feed lines with which it is furnished, comprises a straight or curved terminal part, disposed obliquely with respect to the rectilinear part, by way of which is crossed the annular slot which these lines make it possible to feed, this terminal part being situated in the interior space delimited by the annulus formed by the slot.

8. The antenna according to claim 5, characterized in that each of the feed lines with which it is furnished, comprises a straight or curved terminal part, disposed obliquely with respect to the rectilinear part, by way of which is crossed the annular slot which these lines make it possible to feed, this terminal part being situated in the interior space delimited by the annulus formed by the slot.

9. The antenna according to claim 6, characterized in that each of the feed lines with which it is furnished, comprises a straight or curved terminal part, disposed obliquely with respect to the rectilinear part, by way of which is crossed the annular slot which these lines make it possible to feed, this terminal part being situated in the interior space delimited by the annulus formed by the slot.

10. The antenna, according to claim 1, characterized in that it comprises two feed line switching facilities consisting of earthing diodes, the one turned on and the other turned off alternately by voltages which are applied at the level of the ports respectively provided for the feed lines to which these diodes are individually assigned.

11. The antenna, according to claim 1, characterized in that it comprises feed lines made in microstrip or coplanar technology.

12. The antenna, according to claim 1, characterized in that it comprises at least two annular slots made in the same plane and one inside the other whose annuli, circular or otherwise, are each crossed by two feed lines with which the antenna is furnished.

* * * * *